US008059856B2

(12) United States Patent
Avera

(10) Patent No.: US 8,059,856 B2
(45) Date of Patent: Nov. 15, 2011

(54) METHODS AND APPARATUS FOR PROVIDING A HEAT SINK FOR A LOUDSPEAKER

(75) Inventor: Donald K. Avera, Meridian, MS (US)

(73) Assignee: Peavey Electronics Corporation, Meridian, MS (US)

( * ) Notice: Subject to any disclaimer, the term of this patent is extended or adjusted under 35 U.S.C. 154(b) by 1424 days.

(21) Appl. No.: 11/496,234

(22) Filed: Jul. 31, 2006

(65) Prior Publication Data

US 2008/0025549 A1 Jan. 31, 2008

(51) Int. Cl.
*H04R 1/00* (2006.01)

(52) U.S. Cl. ..... 381/397; 381/433

(58) Field of Classification Search ..... 381/397, 381/433

See application file for complete search history.

(56) References Cited

U.S. PATENT DOCUMENTS

| | | | | |
|---|---|---|---|---|
| 4,547,632 | A * | 10/1985 | Bryson | 381/189 |
| 5,357,586 | A * | 10/1994 | Nordschow et al. | 381/397 |
| 5,748,760 | A * | 5/1998 | Button | 381/412 |
| 7,012,345 | B2 * | 3/2006 | Moro et al. | 310/12.01 |
| 7,057,314 | B2 * | 6/2006 | Moro | 310/12.24 |
| 7,426,283 | B2 * | 9/2008 | Kaiya et al. | 381/397 |
| 7,769,192 | B2 * | 8/2010 | Takagi et al. | 381/172 |
| 2006/0171556 | A1 * | 8/2006 | Jabara | 381/397 |
| 2007/0237351 | A1 * | 10/2007 | Hyde et al. | 381/397 |
| 2008/0056527 | A1 * | 3/2008 | Adamson | 381/409 |

* cited by examiner

*Primary Examiner* — Curtis Kuntz
*Assistant Examiner* — Ryan Robinson
(74) *Attorney, Agent, or Firm* — Matthew B. Dernier, Esq.; Gibson & Dernier, LLP

(57) ABSTRACT

A heat sink for a loudspeaker assembly includes: a housing of generally toroidal shape defining an interior portion and an exterior portion; and a plurality of fins extending from within the interior portion of the housing to, and at least partially over, the exterior portion of the housing.

30 Claims, 3 Drawing Sheets

METHODS AND APPARATUS FOR PROVIDING A HEAT SINK FOR A LOUDSPEAKER

BACKGROUND OF THE INVENTION

The present invention is directed to methods and apparatus for providing a heat sink to draw heat from a voice coil and surrounding structure of a loudspeaker and dissipate such heat.

Loudspeakers (or simply "speakers") are designed for the reproduction of audio signals having a frequency range of approximately 20 Hz to 20 kHz and a pressure range of approximately $10^{-5}$ to 50 pascals, or $10^{-9}$ to $7\times10^{-3}$ lbf/in.$^2$.

A loudspeaker system normally includes one or more drivers (a transducer mechanism without a structural radiation enclosure), a crossover network (ensuring that a received electrical drive signal is within an optimum frequency range), and an enclosure. Loudspeakers are used in many different consumer products, such as home and automobile stereos, television and radio receivers, electronic musical instruments, toys, etc. Loudspeakers are also used in any number of professional applications, such as in broadcast stations, recording studios, concert halls, etc.

Loudspeakers may be classified in accordance with several factors, including type of radiation, type of driving element, reproduction range, and diaphragm shape. The type of radiation may include direct radiation and horn-loaded radiation. The driving element may be a magnetic element, an electrostatic element, a piezoelectric element, an ionophone element, or an air-jet element. Magnetic driving elements include dynamic (moving-coil, ribbon, etc.), moving-armature, and magnetostrictive technologies. Reproduction ranges include low frequency (woofer and subwoofer) ranges, mid-frequency (midrange and squawker) ranges, high-frequency (tweeter and super-tweeter) ranges, and full-ranges. Diaphragm shapes include cone (e.g., straight, parabolic, flared, etc.), dome, and flat shapes.

A commonly used loudspeaker classification is the dynamic (moving-coil) direct-radiator loudspeaker. In this type of loudspeaker, a permanent magnet produces a high flux density in a narrow air gap in which a moving voice coil is located. The interaction of the flux of the permanent magnet and an alternating current flowing within the voice coil produces a force that moves a diaphragm to achieve a piston action. The movement of the diaphragm causes corresponding acoustic sound waves, which are preferably linearly related to the electrical driving signal in order to produce high fidelity sound. Further details concerning conventional loudspeaker technology may be found in McGraw-Hill, Encyclopedia of Electronics and Computers, pp. 512-518 ($2^{nd}$ ed., 1988).

A significant disadvantage associated with the dynamic (moving-coil) direct-radiator loudspeaker is that it has a relatively low radiation efficiency, i.e., a ratio of sound output power to electrical input power. Indeed, the radiation efficiency of this type of loudspeaker is on the order of 0.5 to 4 percent. This inefficiency generally results in a majority of the electrical input power being converted into heat.

The voice coil is the primary heat generating elements of the loudspeaker. Conventional voice coil assemblies include a helical coil of electrical/magnet wire supported by a bobbin. The helical coil may be formed of a single layer or multiple layers of wire and may include multiple coils in axial alignment in the bobbin. As the bobbin is typically used to provide a mechanical connection between the voice coil and the diaphragm (or speaker cone), a relatively high stiffness is desirable. Conventional high-power loudspeakers may employ high-temperature materials in forming the bobbin such that it remains relatively stiff at elevated temperatures. Such materials include high glass transition point materials, i.e., TG and the like.

Permanent magnets formed of ferrite materials (such as ferrite ceramic magnets) have been in use for many years. More recent magnet designs include neodymium iron boron, a high reminence, high coercivity permanent magnet material. As the price of neodymium iron boron magnets continues to drop, and enhancements in material properties (e.g., reducing thermal demagnetization and increasing residual magnetic flux density) continue to occur, neodymium will become a more attractive material for use in audio loudspeakers. A neodymium iron boron magnet enjoys a substantially smaller size, as compared to ferrite magnets, and may weigh only a few ounces (for a 500 watt speaker application). Comparatively, a ferrite magnet may weigh about 8 pounds in the same application.

Cooling of the voice coil, the permanent magnet and surrounding structures continues to be of concern in high performance, high power loudspeaker designs.

Attempts at solving the above-described thermal management issue have been made, including forced air flow, metallic bobbin materials, impregnated bobbin materials, and inside/outside coil assemblies (e.g., a bobbin disposed between two voice coils), heat sinks, etc. Each of these attempts has been unsatisfactory for various reasons. Forced air flow techniques require through-holes in the assembly or increasing the area around the voice coil to permit such air flow. These techniques, however, reduce the magnetic field and degrades performance. Although metallic bobbins exhibit good thermal conductivity, they cause back electromotive force (BEMF), which further reduces the efficiency of the loudspeaker. Impregnated bobbin materials exhibit only marginal improvements in thermal conductivity, while exhibiting poor bonding strength and in some cases, BEMF. In inside/outside voice coil assemblies, the heat buildup between the voice coil and the bobbin (the bond line) is increased by a factor of two and the bond line exhibits poor thermal conductivity as compared with a single (inside or outside) design. This is so because the bond line is subjected to heat from both sides and any heat transfer out of one of the voice coils must traverse a heat source (the opposite voice coil) to reach ambient fluids. Conventional heat sink designs have been unsatisfactory in some applications because the air flow across the heat sink has not resulted in sufficient heat transfer and subsequent cooling of the voice coil and/or the magnet—this problem may be exacerbated in neodymium iron boron magnet designs.

Accordingly, there are needs in the art for new methods and apparatus for dissipating heat from a voice coil and/or a permanent magnet of a loudspeaker.

SUMMARY OF THE INVENTION

A loudspeaker assembly in accordance with one or more embodiments of the present invention includes: a diaphragm having a front side and a rear side; a voice coil bobbin coupled to the rear side of, and being operable to move, the diaphragm; a magnetic structure including a permanent magnet and a substantially central aperture therethrough; and a heat sink having a plurality of fins, at least some of the fins terminating proximate to the aperture of the magnetic structure, and the heat sink including a domed surface facing the aperture of the magnetic structure and being operable to channel air toward the fins.

In accordance with one or more further embodiments of the present invention, a loudspeaker assembly includes: a frame having a front periphery and a rear periphery; a voice coil bobbin; a spider coupling the bobbin to the rear periphery of the frame; and a heat sink having a plurality of fins, at least some of the fins terminating proximate to the rear periphery of the frame, and the heat sink including at least one channel providing an airflow path from a rear side of the spider through to at least some of the fins.

In accordance with one or more further embodiments of the present invention, a heat sink for a loudspeaker assembly, includes: a housing of generally toroidal shape defining an interior portion and an exterior portion; and a plurality of fins extending from within the interior portion of the housing to, and at least partially over, the exterior portion of the housing.

The housing may define a rearwardly directed opening and a forwardly directed opening, the openings being aligned along an axis; and the fins extend in planes that are substantially parallel with the axis. The fins may extend into the rearwardly directed opening and couple to the interior portion of the housing. The heat sink may further include a deflector element coupled to the fins such that it is positioned proximate to the rearwardly directed opening, the deflector element including and positioning a domed surface toward the rearwardly directed opening. The deflector element is preferably positioned with respect to the rearwardly directed opening of the housing to define a plurality of channels from the interior of the housing past the fins. The domed surface of the deflector element may be operable to direct air transversely with respect to the axis and toward the channels and the fins.

The channels are preferably sized to provide an open area greater than the open area of the central aperture of the magnetic structure. This is intended to reduce the velocity of the air flow through the aperture and to prevent air/wind noise (such as a whistling noise).

The heat sink my include a peripheral flange extending radially from the exterior portion of the housing and being operable to couple to a frame of the loudspeaker, wherein the flange defines a plurality of channels for carrying air to the fins that are extending over the exterior portion of the housing. When coupled to the frame, a rear side of a spider, an exterior of a voice coil bobbin, the frame, and the heat sink may define an annular volume. The channels preferably provide airflow paths from the volume past the fins. Each channel may extend into a respective space between the frame and the peripheral flange. The peripheral flange may include a plurality of apertures extending therethrough, each aperture communicating with a respective one of the spaces to permit air to flow to and from the space and past the fins. The central ring-shaped housing may also include an interior portion and an exterior portion, and the peripheral flange and apertures therethrough are radially spaced from the exterior portion of the housing. The fins of the heat sink may extend from the interior portion of the ring-shaped housing to the peripheral flange.

Other aspects, features, advantages, etc. will become apparent to one skilled in the art in view of the description herein taken in conjunction with the accompanying drawing.

BRIEF DESCRIPTION OF THE DRAWINGS

For the purposes of illustrating the invention, there are shown in the drawings forms that are presently preferred, it being understood, however, that the invention is not limited to the precise arrangements and instrumentalities shown.

DETAILED DESCRIPTION OF THE INVENTION

Figure 1:
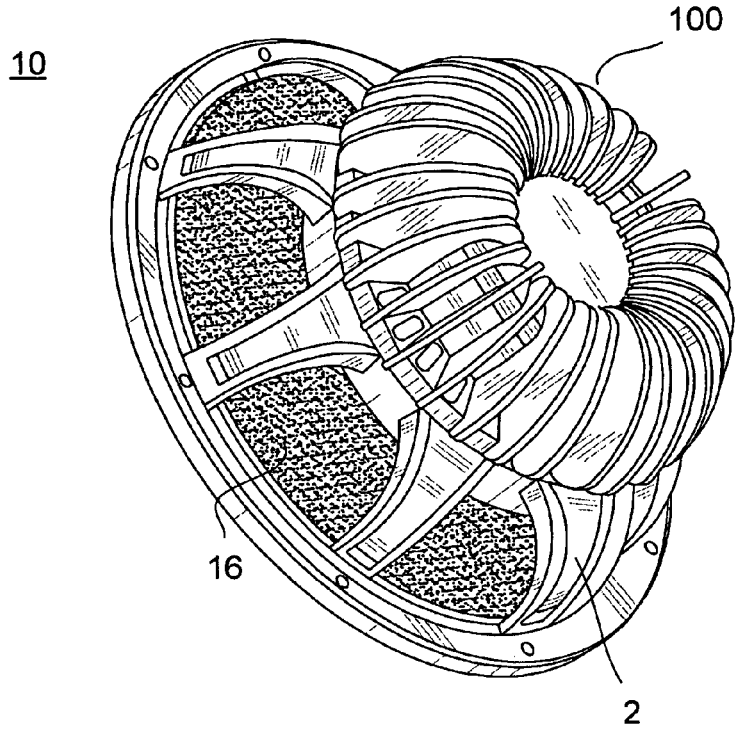
FIG. 1 is a perspective view of a loudspeaker assembly employing one or more aspects of the present invention.

With reference to the drawings, wherein like numerals indicate like elements, there is shown in FIG. 1 a loudspeaker assembly 10 employing one or more aspects of the present invention. The loudspeaker assembly 10 includes a frame 2, a heat sink, 100, a driver (not shown), and a diaphragm (or cone) 16. As is well understood in the art, the driver (which includes the magnetic and electromagnetic components of the loudspeaker 10) is operable to move the diaphragm 16 in response to a source of voltage/current to create acoustic energy. The heat sink 100 is operable to remove heat from one or more of the driver components.

Figure 2:
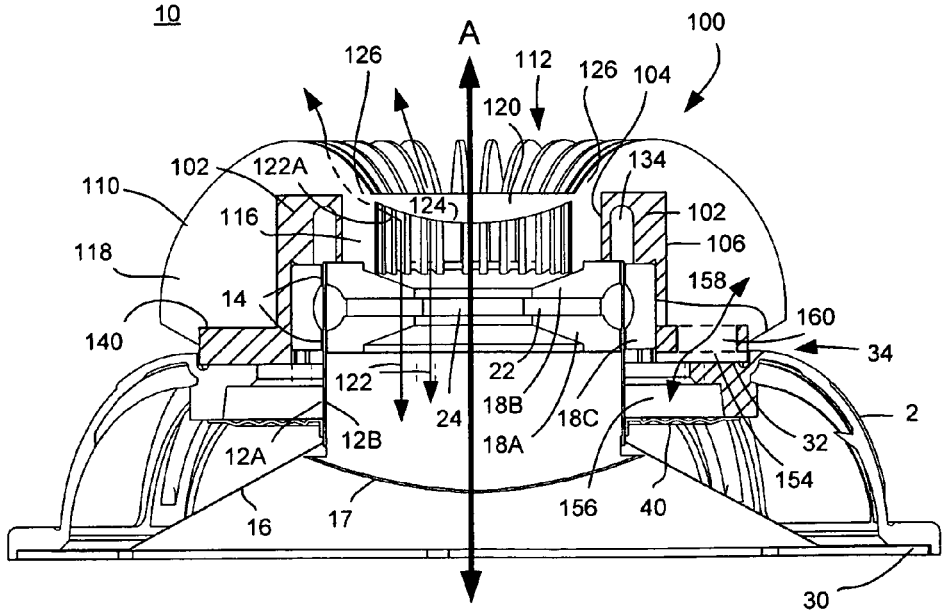
FIG. 2 is a side-sectional view of the loudspeaker assembly of FIG. 1.

FIG. 2 is a side-sectional view of the loudspeaker assembly 10 and shows additional structural details. The cone 16 is driven by an electromagnetic structure (driver) that includes a bobbin 12, one or more voice coils 14, and a permanent magnet 22, and a plurality of pole pieces 18A, 18B, 18C. In the illustrated embodiment, two voice coils 14 are employed (each being oppositely wound), although any number of voice coils may be employed. In general, the permanent magnet 22 induces a magnetic flux in the pole pieces 18 such that the magnetic flux is directed into respective annular gaps between the pole pieces 18A and 18C and between the pole pieces 18B and 18C. As the respective voice coils 14 are disposed in the gaps between the pole pieces 18A, 18B, 18C, the magnetic flux flows through the voice coil(s) 14.

An electrical drive signal is applied to the voice coil(s) 14 in order to induce an alternating current in the voice coil(s) 14, which creates a proportional electromagnetic flux. The electromagnetic flux of the voice coils 14 interacts with the magnetic flux produced by the permanent magnet 22, thereby creating a force on the voice coils 14 in the upward/downward direction. The force tends to move the voice coils 14 and the bobbin 12 (because the voice coil 14 is mechanically coupled to the bobbin 12). As an inner peripheral edge 30 of the diaphragm 16 is mechanically coupled to the bobbin 12, the movement of the bobbin 12 in response to the electrical drive signal causes a corresponding movement of the diaphragm 16. The movement of the diaphragm 16 creates sound waves in proportion to the electronic drive signal.

The bobbin 12 is preferably substantially cylindrical in shape and includes a wall member having an outer surface 12A and an inner surface 12B. The voice coils 14 are preferably supported by the bobbin 12. The bobbin 12 may be constructed of a single layer or may include additional layers to improve mechanical stiffness. By way of example, the bobbin 12 may be formed from a high temperature material, such as polyimide, aluminum, aromatic fiber, etc., with a high glass transition point, TG.

The voice coils 14, which may be of conventional construction, may exhibit a real resistance of approximately 2, 4, 8, or 16 Ohms. Other resistances are also contemplated. The current induced in the voice coils 14 by way of the electrical drive signal causes a temperature rise in the voice coils 14, which over time tends to reduce the useful life of the loudspeaker 10. This temperature rise also increases the resistance of the voice coils 14 and reduces the efficiency of the loudspeaker 10 (sometimes by 50%). So-called power compression may also occur. Power compression occurs when an operator increases the electrical drive signal (e.g., current) to the loudspeaker 10 in order to compensate for a lower acoustic output power resulting from the reduction in efficiency (caused by a temperature increase in the voice coils 14). The increased drive signal contributes to further increases in the temperature and resistance of the voice coils 14, and further reductions in efficiency and acoustic output power. This is an undesirable positive feedback scenario. In accordance with one or more aspects of the present invention, however, advantageous thermal management is employed, which tends to reduce the temperature elevation in the voice coil 14 resulting from the electrical drive signal.

The frame 2 includes a front periphery 30 and a rear periphery 32 that cooperate to provide support and interconnectivity among the bobbin 12, the diaphragm 16, the magnetic structure, and the heat sink 100. The loudspeaker 10 employs a two-piece suspension system, preferably the flexure system. The front periphery 30 of the frame 2 supports a relatively large flexible membrane (the surround) circumscribing the outside edge of the diaphragm 16. The rear periphery 32 of the frame 2 supports an additional flexure (the spider 40), which connects to the bobbin 12 proximate to the junction of the bobbin 12 and the diaphragm 16. The flexure system permits the bobbin 12 and the diaphragm 16 to move axially within the frame in response to the forces produced by the permanent magnet 22 and the voice coils 14.

The rear periphery 32 of the frame 2 also supports the heat sink 100 and the magnetic structure, including the permanent magnet 22 and the pole pieces 18. The heat sink 100 includes a central ring-shaped (or toroidal) housing 102 defining an interior portion 104 and an exterior portion 106. The heat sink 100 also includes a plurality of fins 110 that assist in transferring heat generated by the permanent magnet 22 and the voice coils 14 to the ambient air.

In accordance with one or more embodiments of the present invention, the fins 110 extend from within the interior portion 104 of the housing 102 and at least partially over the exterior portion 106 of the housing 102. The housing 102 defines a rearwardly directed opening 112 and a forwardly directed opening 114, where the openings 112, 114 are aligned along an axis A of the loudspeaker 10. The fins 110 lie in respective planes that are substantially parallel with the axis A. Each of the fins 116 include a first portion 116 disposed in the interior portion 104 of the housing 102 and a second portion 118 disposed at the exterior portion 106 of the housing 102.

The heat sink 100 further includes a deflector element 120 that is coupled to the fins 110 such that it is positioned proximate to the rearwardly directed opening 112. For example, the deflector element 120 may function to at least partially obstruct the rearwardly directed opening 112 to achieve desirable air flow characteristics. For example, the movement of the diaphragm 16, and the dust cover 17 in particular, will cause air to flow 122 in and out of the rearwardly directed opening 112 of the heat sink 100. Indeed, the magnetic structure includes a substantially central aperture 24 that permits air to travel from within the bobbin 12 into the interior portion 104 of the housing 102. As the movement of the diaphragm 16 is generally in the direction of the axis A, the airflow 122 will tend to also be in the direction of the axis A. The deflector element 120, however, is preferably operable to cause at least some of the airflow 122A (and/or components thereof) in one or more directions transverse to the axis A.

By way of example, the deflector element 120 may include a domed surface 124 directed toward the rearwardly directed opening 112, which has been found to assist in directing the airflow 122A transversely with respect to the axis A. The positioning of the deflector element 120 with respect to the rearwardly directed opening 112 defines a plurality of channels 126 from the interior portion 104 of the housing 102 past the fins 110 and out to the ambient air. The creation of the channels 126 assists in directing the airflow 122 past the fins 110, thereby improving the heat dissipation characteristics of the heat sink 100. This is believed to improve the cooling of the magnetic structure and the voice coils 14. The channels 126 are preferably sized to provide an open area greater than the open area of the central aperture 24 of the magnetic structure. This is intended to reduce the velocity of the air flow 122 through the aperture 24—and the sizing of the channels is intended to prevent air/wind noise (such as a whistling noise). This, in turn, requires that the air trapped beneath the dust cap 17 has to travel through magnetic structure and out past the heat sink 100 as the cone (diaphragm) 16 moves rearwardly. Air flow 122 in the opposite direction through the same path is obtained when the diaphragm 16 moves forward.

Figure 3:
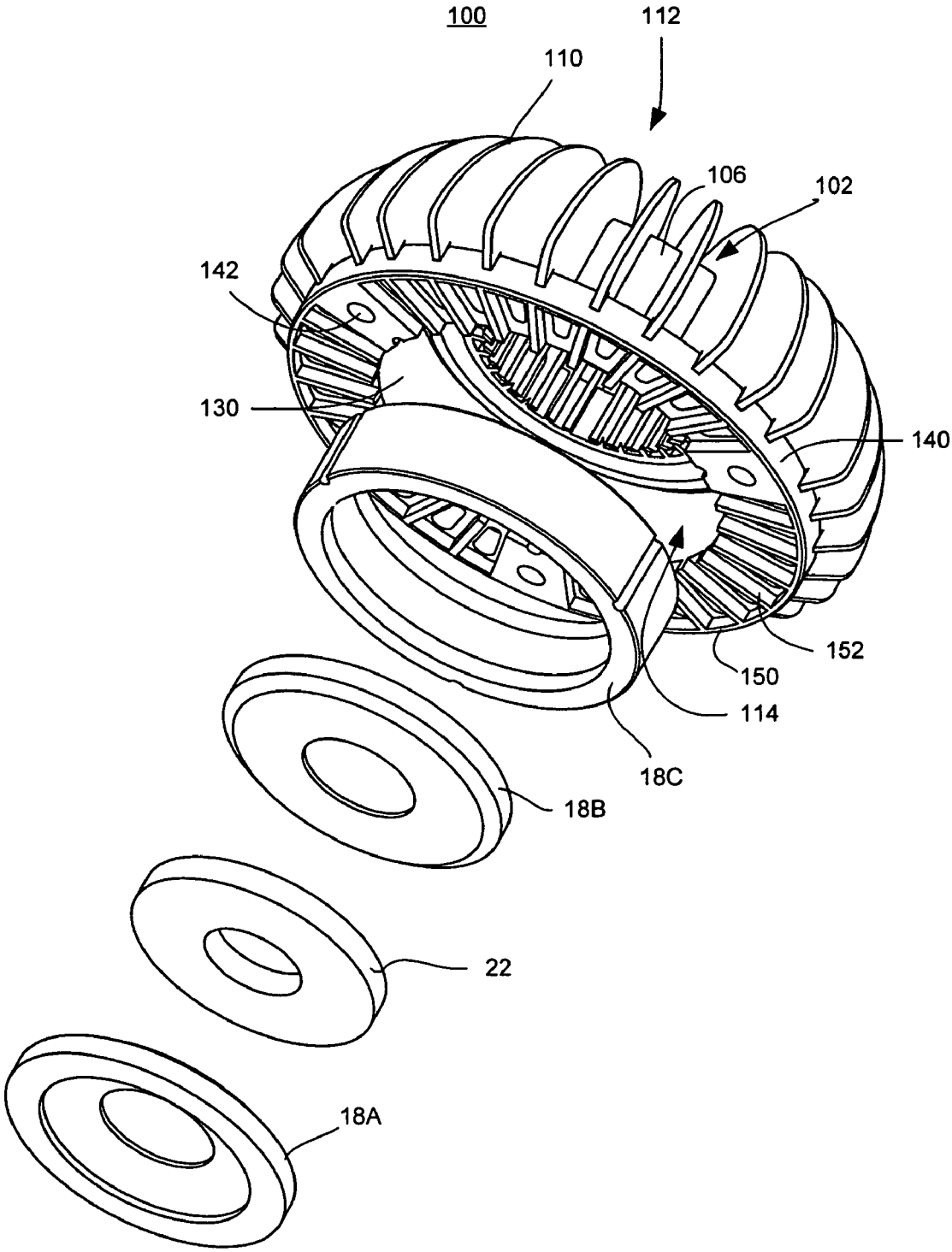
FIG. 3 is an exploded view of the heat sink and magnet structures of FIG. 3.
Figure 4:
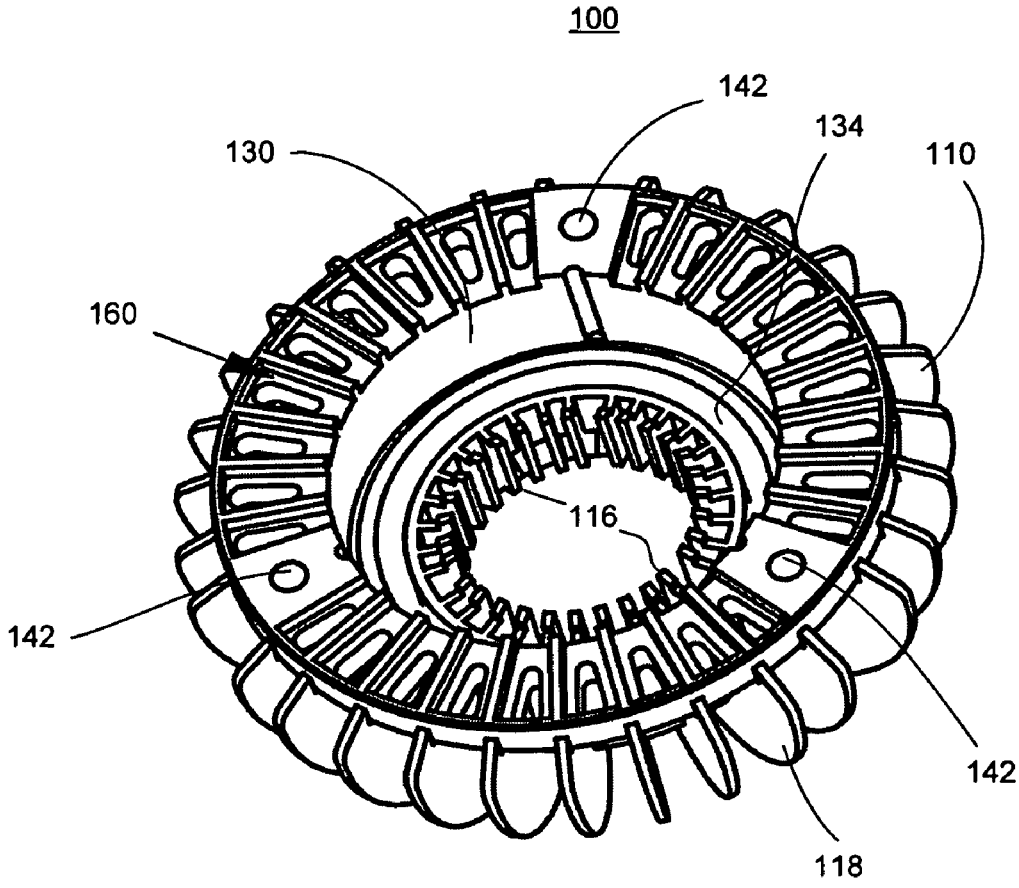
FIG. 4 is a bottom perspective view of the heat sink of FIG. 1.

The interior portion 104 of the housing 102 may include a recess 130 that is sized and shaped to receive the magnetic structure. As best seen in FIG. 3, the recess 130 may be generally cylindrical in shape in order to receive a toroid-shaped pole piece (or magnetic return ring) 118C. The pole pieces 118A, 118B may sandwich the permanent magnet 22 and be received within the central portion of the pole piece 118C. As shown in FIG. 2, the pole pieces 118A, 118B and the permanent magnet 22 are positioned such that the annular gap is defined and sized to receive the bobbin 12 and the voice coils 14. The housing 102 may also include an annularly shaped undercut 134 that is positioned proximate to and bridging the gap between the pole pieces 18B, 18C. This insures that the material of the heat sink (such as aluminum or other metals or metal alloys) does not interfere with the magnetic flux through the gap and allows the coil(s) 14 to move to their maximum excursion.

The magnetic structure (e.g., the pole pieces 18 and the permanent magnet 22) form a generally toroidal shape having a forward portion directed toward the diaphragm 16, a rearward portion directed toward the deflector element 120, and an annular side portion that engages the recess 130 of the heat sink 100. The first portions 116 of the fins 110 preferably extend to or toward the rearward portion of the magnetic structure and the central aperture 24 thereof. The fins 110 preferably extend from the rearward portion of the magnetic structure and around the toroid shape of the housing 102.

The heat sink 100 also includes a peripheral flange 140 extending from the exterior portion 106 of the housing 102. The flange 140 is thus of a generally annular shape and is preferably sized to engage the rear periphery 32 of the frame 2. By way of example, the flange 140 may include a plurality of apertures 142 through which appropriate fastening means (such as bolts) may fasten the heat sink 100 to the frame 2. In this way, the heat sink 100 positions the magnetic structure in alignment with the bobbin 12 and the voice coils 14 such that the bobbin 12 and voice coils 14 may enter the gap formed by the pole pieces (or magnetic return ring) 18. The ability to disengage the fasteners and remove the heat sink 110 in order to gain access to the bobbin 12, the voice coils 14, and the magnetic structure advantageously permits field retrofit activities and repair.

Preferably, the second portions 118 of the fins 110 extend along the exterior portion 106 of the housing 102 and terminate at or near the peripheral flange 140. The forward side of the flange 140 preferably includes a lip 150 and/or one or more stand-offs 152 that space the flange 140 away from a rear surface 34 of the rearward portion 32 of the frame 2 in order to create a space 154. The space 154 communicates with a volume defined by a rear side of the spider 40, the exterior surface 12A of the bobbin 12, the rearward portion of the frame 2, the pole piece 18C and the flange 140 of the heat sink. Air 158 within the volume 156 may move in response to the movement of the spider 40 and or the bobbin 12. The space 154 (or the plurality of spaces 154 assuming that stand-offs 152 are employed) permit the air 158 to escape from the volume 156 to or toward the fins 110 of the heat sink 100. The apertures are preferably sized large enough to reduce the velocity of air movement, as discussed above, which reduces air/wind noise. Additionally, the flange 140 includes one or more apertures 160 that communicate with the respective spaces 154 to permit the air 158 to pass therethrough to the fins 110 of the heat sink 100.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. A loudspeaker assembly, comprising:

a diaphragm having a front side and a rear side;

a voice coil bobbin coupled to the rear side of, and being operable to move, the diaphragm;

a magnetic structure including a permanent magnet and a substantially central aperture therethrough; and a heat sink having a plurality of fins located outside of the central aperture of the magnetic structure, with at least some of the fins terminating proximate to the aperture of the magnetic structure, and the heat sink including a domed surface outside of and facing the aperture of the magnetic structure and being operable to channel air toward the fins.

2. The loudspeaker assembly of claim 1, wherein the diaphragm, aperture of the magnetic structure, and the domed surface are in axial alignment along an axis, and the domed surface channels the air transversely with respect to the axis.

3. The loudspeaker assembly of claim 1, wherein:

the magnetic structure is of a generally toroidal shape having a forward portion directed toward the diaphragm, a rearward portion, and an annular side portion; and the fins of the heat sink extend from the rearward portion and around the toroid shape to the side portion.

4. The loudspeaker assembly of claim 1, wherein:

the heat sink includes a central ring-shaped housing defining an interior portion and an exterior portion, the interior portion including a recess sized and shaped to receive the magnetic structure and an inner surface; and the fins of the heat sink extend from the interior portion of the ring-shaped housing to the exterior portion thereof.

5. The loudspeaker assembly of claim 4, wherein:

the ring-shaped housing defines a rearwardly directed opening and a forwardly directed opening; and the fins of the heat sink extend into the rearwardly directed opening and couple to the interior portion of the ring-shaped housing.

6. The loudspeaker assembly of claim 5, further comprising a deflector element coupled to the fins of the heat sink such that it is positioned proximate to the rearwardly directed opening of the ring-shaped housing, the deflector element including and positioning the domed surface toward the rearwardly directed opening, wherein the aperture of the magnetic structure, the rearwardly directed opening, and the domed surface are in alignment along an axis.

7. The loudspeaker assembly of claim 6, wherein the deflector element is positioned with respect to the rearwardly directed opening of the ring-shaped housing to define a plurality of channels from the interior of the ring-shaped housing past the fins of the heat sink.

8. The loudspeaker assembly of claim 7, wherein the domed surface of the deflector element is operable to direct air transversely with respect to the axis and toward the channels and the fins of the heat sink.

9. The loudspeaker assembly of claim 7, wherein the channels are sized to provide an area greater than an open area of the central aperture of the magnetic structure.

10. The loudspeaker assembly of claim 4, wherein the heat sink includes a peripheral flange extending from the ring-shaped housing.

11. The loudspeaker assembly of claim 10, wherein the fins of the heat sink extend from the interior portion of the ring-shaped housing to the peripheral flange.

12. The loudspeaker assembly of claim 10, wherein the peripheral flange is couple to a frame of the loudspeaker.

13. A loudspeaker assembly, comprising:

a frame having a front periphery and a rear periphery;

a voice coil bobbin;

a spider coupling the bobbin to the rear periphery of the frame; and a heat sink including a peripheral flange extending from an exterior portion of thereof and being removably coupled to the rear periphery of the frame, the heat sink having a plurality of fins, at least some of the fins terminating proximate to the rear periphery of the frame, and the heat sink including at least one channel providing an airflow path from a rear side of the spider through to at least some of the fins, wherein:

the rear side of the spider, an exterior of the bobbin, the frame, and the heat sink define an annular volume, and the heat sink includes a plurality of channels that provide airflow paths from the volume past the fins.

14. The loudspeaker assembly of claim 13, wherein:

the heat sink includes a central ring-shaped housing and a peripheral flange extending radially from the ring-shaped housing and coupling to the frame; and each channel extends into a respective space between the frame and the peripheral flange.

15. The loudspeaker assembly of claim 14, wherein the peripheral flange includes a plurality of apertures extending therethrough, each aperture communicating with a respective one of the spaces to permit air to flow to and from the space and past the fins.

16. The loudspeaker assembly of claim 15, wherein the central ring-shaped housing includes an interior portion and an exterior portion, and the peripheral flange and apertures therethrough are radially spaced from the exterior portion of the housing.

17. The loudspeaker assembly of claim 16, wherein the fins of the heat sink extend from the interior portion of the ring-shaped housing to the peripheral flange.

18. A heat sink for a loudspeaker assembly, comprising:

a housing of generally toroidal shape defining an interior portion and an exterior portion, a rearwardly directed opening and a forwardly directed opening, the openings being aligned along an axis; and a plurality of fins extending in planes that are substantially parallel with the axis and from within the interior portion of the housing to, and at least partially over, the exterior portion of the housing, and where the fins extend into the rearwardly directed opening and couple to the interior portion of the housing.

19. The heat sink of claim 18, further comprising a deflector element coupled to the fins such that it is positioned proximate to the rearwardly directed opening, the deflector element including and positioning a domed surface toward the rearwardly directed opening.

20. The heat sink of claim 19, wherein the deflector element is positioned with respect to the rearwardly directed opening of the housing to define a plurality of channels from the interior of the housing past the fins.

21. The heat sink of claim 19, wherein the domed surface of the deflector element is operable to direct air transversely with respect to the axis and toward the channels and the fins.

22. The heat sink of claim 19, wherein the interior portion includes a recess for receiving a magnetic structure of the loudspeaker, the magnetic structure including a permanent magnet and a substantially central aperture therethrough; and the channels are sized to provide an area greater than an open area of the central aperture of the magnetic structure.

23. The heat sink of claim 18, further comprising a peripheral flange extending radially from the exterior portion of the housing and being operable to couple to a frame of the loudspeaker, wherein the flange defines a plurality of channels for carrying air to the fins that are extending over the exterior portion of the housing.

24. The heat sink of claim 23, wherein:

when coupled to the frame, a rear side of a spider, an exterior of a voice coil bobbin, the frame, and the heat sink define an annular volume; and the channels provide airflow paths from the volume past the fins.

25. The heat sink of claim 24, wherein each channel extends into a respective space between the frame and the peripheral flange.

26. The heat sink of claim 25, wherein the peripheral flange includes a plurality of apertures extending therethrough, each aperture communicating with a respective one of the spaces to permit air to flow to and from the space and past the fins.

27. The heat sink of claim 26, wherein the central ring-shaped housing includes an interior portion and an exterior portion, and the peripheral flange and apertures therethrough are radially spaced from the exterior portion of the housing.

28. The heat sink of claim 27, wherein the fins of the heat sink extend from the interior portion of the ring-shaped housing to the peripheral flange.

29. A loudspeaker assembly, comprising:

a diaphragm having a front side and a rear side;

a voice coil bobbin coupled to the rear side of, and being operable to move, the diaphragm;

a magnetic structure including a permanent magnet and a substantially central aperture therethrough, the magnetic structure having a generally toroidal shape having a forward portion directed toward the diaphragm, a rearward portion, and an annular side portion; and a heat sink having a plurality of fins, at least some of the fins extending from the rearward portion of the magnetic structure and around the toroid shape thereof to the side portion, and terminating proximate to the aperture of the magnetic structure, and the heat sink including a domed surface facing the aperture of the magnetic structure and being operable to channel air toward the fins.

30. A loudspeaker assembly, comprising:

a diaphragm having a front side and a rear side;

a voice coil bobbin coupled to the rear side of, and being operable to move, the diaphragm;

a magnetic structure including a permanent magnet and a substantially central aperture therethrough; and a heat sink including a central ring-shaped housing defining an interior portion and an exterior portion, the interior portion including a recess sized and shaped to receive the magnetic structure and an inner surface, the heat sink having a plurality of fins, at least some of the fins extending from the interior portion of the ring-shaped housing to the exterior portion thereof, and terminating proximate to the aperture of the magnetic structure, and the heat sink including a domed surface facing the aperture of the magnetic structure and being operable to channel air toward the fins.

* * * * *